United States Patent [19]

Corrado et al.

[11] Patent Number: 4,982,879

[45] Date of Patent: Jan. 8, 1991

[54] BOTTLE CONTENTS DISPENSING AND CONTENTS PRESERVATION APPARATUS

[75] Inventors: Pat Corrado, St. Petersburg; Stephen Corrado, Seminole, both of Fla.

[73] Assignee: APF Industries, St. Petersburg, Fla.

[21] Appl. No.: 526,955

[22] Filed: May 23, 1990

Related U.S. Application Data

[63] Continuation of Ser. No. 456,193, Dec. 19, 1989, abandoned, which is a continuation of Ser. No. 204,303, Jun. 9, 1988, abandoned.

[51] Int. Cl.[5] ..... B67D 5/08

[52] U.S. Cl. ..... 222/400.7; 222/399; 222/402.1; 222/402.25; 222/501

[58] Field of Search ..... 222/400.7, 399, 394, 222/400.8, 402.1, 402.2, 402.25, 501, 518, 545, 559, 567, 568

[56] References Cited

U.S. PATENT DOCUMENTS

| | | | |
|---|---|---|---|
| 2,105,051 | 1/1938 | Myers | 222/568 X |
| 2,189,643 | 2/1940 | Ward | 299/95 |
| 2,593,770 | 4/1952 | Kollsman | 261/64 |
| 2,678,747 | 5/1954 | Caitung | 222/402.25 X |
| 2,698,113 | 12/1954 | Linton | 222/567 X |
| 2,721,003 | 10/1955 | Linton | 222/567 X |
| 3,065,883 | 11/1962 | Nelson | 222/323 |
| 3,150,799 | 9/1964 | Flynn | 222/52 |
| 3,197,144 | 7/1965 | Kochner | 239/308 |
| 3,464,435 | 9/1969 | Lamb et al. | 137/212 |
| 3,679,104 | 7/1972 | Giroud | 232/396 |
| 3,863,673 | 2/1975 | Sitton | 137/614 |
| 3,883,043 | 5/1975 | Lane | 222/82 |
| 4,129,236 | 12/1978 | Wrycraft et al. | 222/568 X |
| 4,380,306 | 4/1983 | Knopf | 222/400.7 X |
| 4,392,578 | 7/1983 | Fipp et al. | 215/231 |
| 4,473,174 | 9/1984 | Heuser | 222/152 |
| 4,595,121 | 6/1986 | Schultz | 222/1 |
| 4,632,276 | 12/1986 | Makino | 222/80 |
| 4,674,662 | 6/1987 | Bergstrom et al. | 222/399 |
| 4,679,602 | 7/1987 | Hollis et al. | 141/19 |
| 4,706,847 | 11/1987 | Sankey et al. | 222/399 X |
| 6,612,354 | 10/1971 | Sitton et al. | 222/80 |

FOREIGN PATENT DOCUMENTS

| | | | |
|---|---|---|---|
| 294786 | 9/1915 | Fed. Rep. of Germany | 222/501 |

*Primary Examiner*—David H. Bollinger

*Attorney, Agent, or Firm*—Kerkam, Stowell, Kondracki & Clarke

[57] ABSTRACT

A bottle, dispensing and contents preservation apparatus has a dispensing nozzle provided with structures for locking the dispenser nozzle to a bottle neck to reduce accidental release of the dispenser when the container is pressurized. The source of pressurizing fluid may be from a manifold, connected to a large source of pressurized gas, a cylinder of pressurized gas or a disposable gas cartridge.

5 Claims, 3 Drawing Sheets

BOTTLE CONTENTS DISPENSING AND CONTENTS PRESERVATION APPARATUS

This is a continuation of application Ser. No. 456,193, filed Dec. 19, 1989, now abandoned, which is a continuation of Ser. No. 204,303, filed June 9. 1988, now abandoned.

This invention is directed to apparatus for dispensing and preserving flowable materials and in particular for wine in container bottles.

BACKGROUND OF THE INVENTION

It is known in the art to reduce or prevent spoilage of oxidizable flowable materials by maintaining in a container for the flowable materials an inert atmosphere and it is also known to provide means whereby pressurized containers have means for releasing the internal pressure before the container lid is removed. Examples of the prior art showing such methods and means comprise the Lane U.S. Pat. No. 3,883,043 and the Kollsman U.S. Pat. No. 2,593,770.

BRIEF SUMMARY OF THE INVENTION

The invention comprises a bottle contents dispensing and contents preserving apparatus wherein a source of pressurized gas may be directed to the upper end of a container of flowable fluid and means are provided for locking the dispenser to, for example a bottle neck to thereby reduce accidental release of the dispenser while the container is pressurized.

BRIEF DESCRIPTION OF THE DRAWING

The invention will be more particularly described in reference to the accompanying drawing wherein.

DETAILED DESCRIPTION OF THE INVENTION

Figure 1:
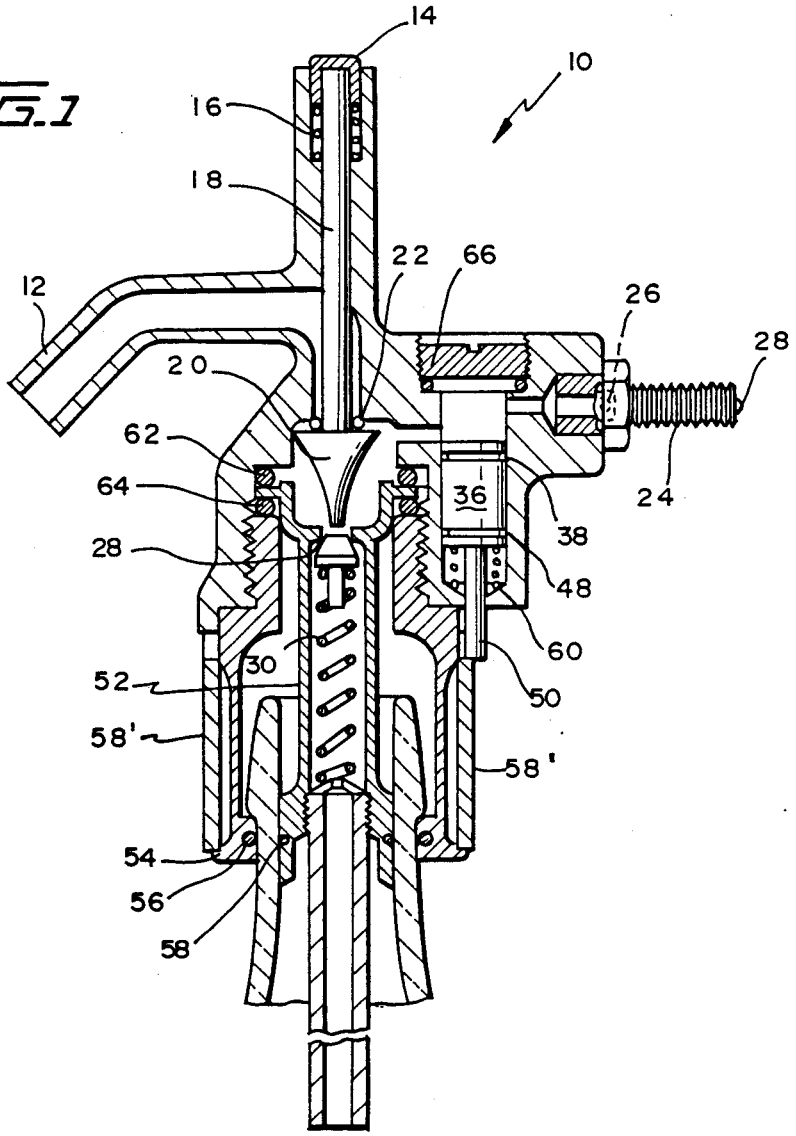
FIG. 1 illustrates, in partial cross-section, a vertical dispensing nozzle connectable to a source of preferably inert pressure fluid and having a locking sleeve to prevent removal of the dispensing nozzle while a container is pressurized.

Referring specifically to FIG. 1 there is illustrated a vertical dispensing nozzle (10) including an outlet nozzle (12), a plunger button (14), spring urge by spring (16) in an upwardly direction relative to FIG. 1. The button (14) has connected thereto a plunger rod (18) having a conical tip (20). When the plunger is in the position illustrated in FIG. 1 the base of the conical tip (20) is sealed against leakage by O-ring (22). Pressurized gas such as nitrogen is connected from a source not shown to a filler valve (24) of conventional construction which in the preferred form of the invention has a ball check shown diagrammatically in broken lines at (26) and a stem (28) so that once the container and nozzle elements are pressurized the ball check (26) will seat and retain the internal pressure.

The tip of the conical plunger (20) operates a shut off valve (28) urged by spring (30) into sealing engagement with a valve seat (32). To release the contents of the bottle (34) the plunger (14) is urged downwardly pushing the valve seat (28) into the open position so that the contents of the bottle (e) can be released. During the pressurization of the bottle (34) fluid pressure entering the filler valve (24) urges the piston (36) having upper and lower O-ring seals (38) and (48) downwardly moving the attached plunger (50) in the same direction whereby pressure gas can move the shut off valve (28) downwardly to pressurize the bottle. Surrounding the filler tube (52) is a split bottle neck holder (54) having associated therewith a pair of O-rings (56) and (58). After the dispenser has been slipped over the bottle (34) a locking cylindrical sleeve (58') can be urged downwardly by pressure fluid via the piston (36) and plunger (50). With the plunger holding the locking sleeve (58') in the locked position, the dispenser cannot be accidentally removed from the bottle neck as long as pressure fluid remains in the bottle, the chamber surrounding the conical plunger (20) and the upper end of the piston (36). When pressure is released the spring (60) can move the piston (36) upwardly and its attached plunger (50) so that the locking ring (58') can be manually moved upwardly.

Other sealing O-rings such as (62), (64) and (66) complete the construction.

When a container containing for example wine is pressurized with nitrogen, oxygen is not available to oxidize the contents and thus permitting storage of "open" wine for a substantial time period as is known in the art.

Figure 2:
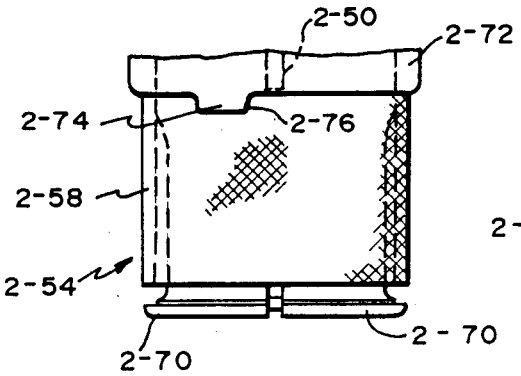
FIG. 2 illustrates a modified form of locking sleeve.
Figure 3:
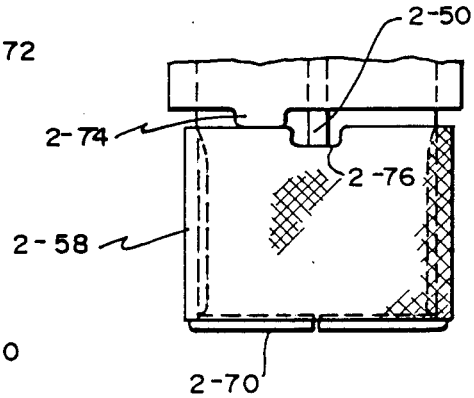
FIG. 3 is another view of the structures shown in FIG. 2 with the locking sleeve in the locked position.

Referring now to FIGS. 2 and 3, a modified form of locking means is illustrated. The unit includes a split cylinder generally designated (2-54) made up of segments (2-70) which, as in the prior form of the invention, grip the neck of the bottle below the lip. The assembly also includes a cylinder (2-58) which is rotatable about the split sleeve (2-54). Above the cylinder a portion of the nozzle (2-72) is provided with a dog (2-74) which mates with a recess (2-76) when the cylinder (2-58) is in the non-locking position. When the plunger pin (2-50) is urged downwardly moving the cylinder (2-58) into engagement with the lower end of the split sleeves (2-70) the cylinder (2-58) can be rotated to the position illustrated in FIG. 3, where the dog (2-74) is out of engagement with the slot (2-76) thus even if pressure fluid holding the piston downwardly, not shown, connected to the plunger (2-50), the ring or cylinder (2-58) will not permit release of the nozzle.

Figure 4:
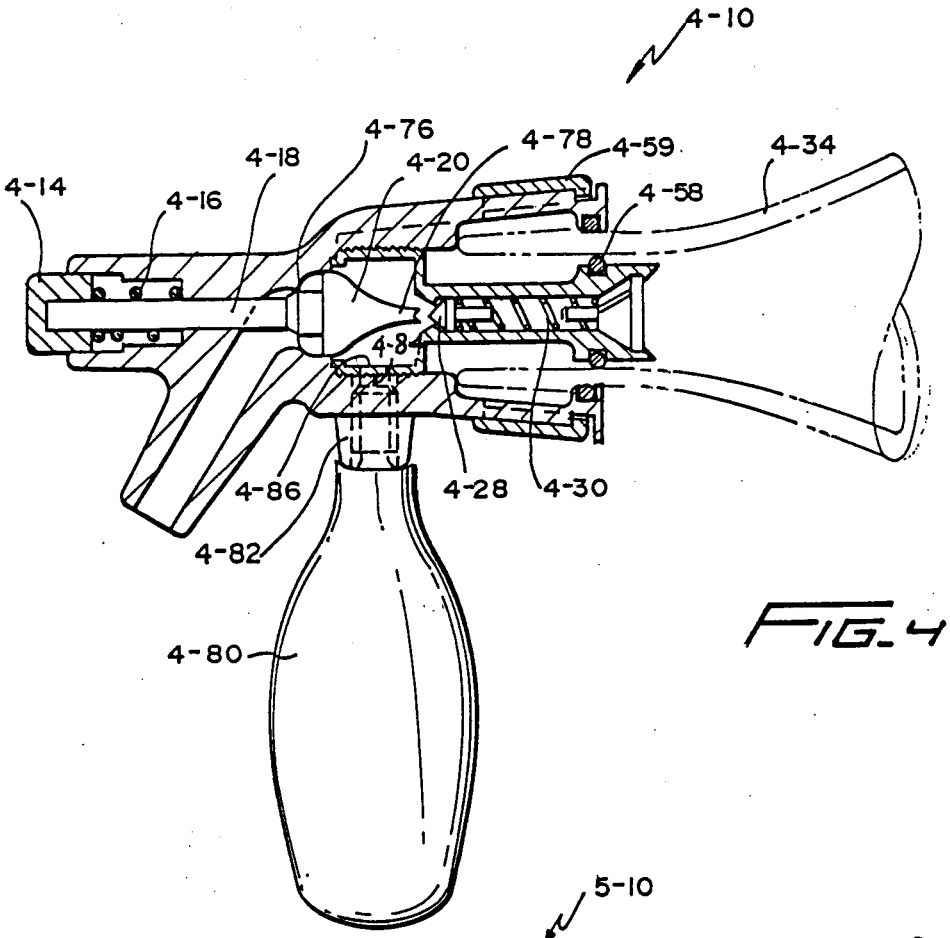
FIG. 4 is a modified form of the present invention and illustrates a dispenser having as its source of inert atmosphere a gas cartridge.

Referring now to FIG. 4, there is illustrated in partial section a modified form of dispensing and preserving nozzle designated (4-10). In FIG. 4 a portion of, for example a wine bottle (4-34) is illustrated. The nozzle (4-10) includes a push button (4-14) spring urged in the upwardly position by spring (4-16). The valve (4-14) has attached to the plunger a stem (4-18) and a cut off valve (4-20) which seats against a surface of the nozzle (4-76). When the button (4-14) is depressed the lower end of the shaped plunger (4-78) opens a further valve having a valve seat member (4-28). The valve (4-28) is spring urged by spring (4-30) into the valve close position.

The lower end of the of the dispenser nozzle (4-10) which is received internally of the bottle (4-34) has an O-ring seal (4–58) associated therewith. The assembly also includes a locking cylinder (4–59) which may take the form illustrated in FIGS. 1, 2, or 3.

In order to pressurize the contents of the bottle (4–34) and to maintain an inert atmosphere therein, there is provided a gas cartridge (4–80) which screws into a nipple (4–82) of conventional designs. Internally of the nipple is a spring urged pin (4–84) having an internal head (4–86) which is pressed inwardly to puncture the upper end of the cartridge (4–80) when the valve seating member (4–20) is pressed inwardly and engages the cap or head (4–86). Pressure from the gas cartridge (4–80) then fills the space about the plunger (4–20) and the pressure urges valve seat (4–28) inwardly, permitting nitrogen to flow into the bottle (4–34) and replace the oxygen therein.

Figure 5:
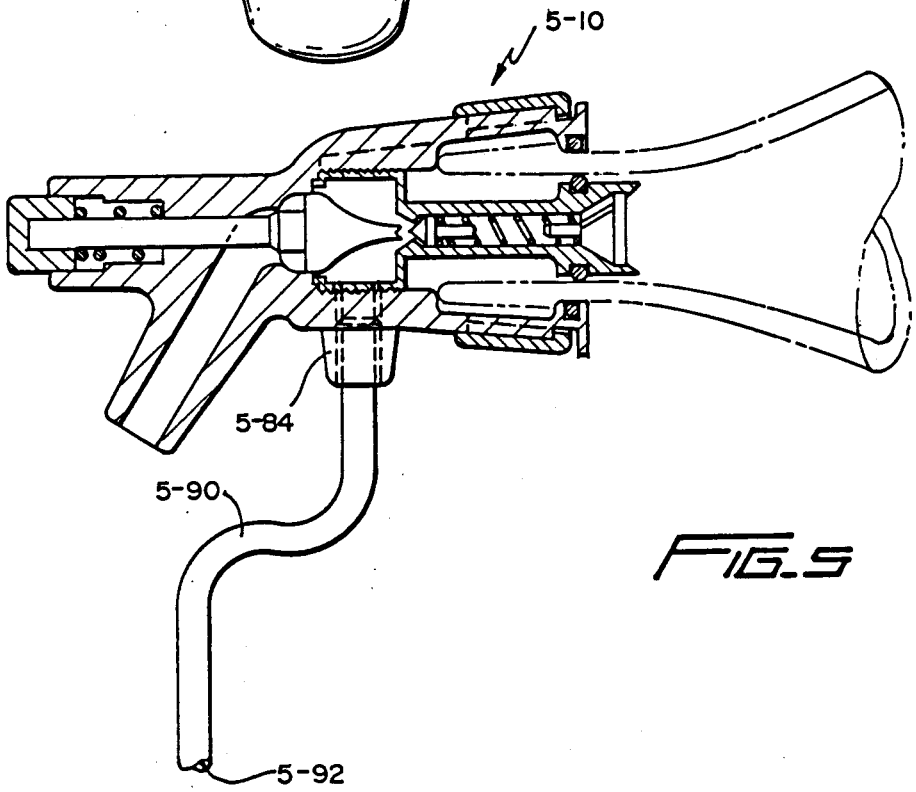
FIG. 5 is a view like a combination of FIGS. 1 and 4 having connection to a large volume gas tank for multiple dispensing.

Referring now to FIG. 5, the dispenser nozzle (5–10) is structured like the dispenser nozzle (4–10) illustrated in FIG. 4 except that the nipple (5–84) is configured to receive a flexible pressurizable conduit (5–90) which has its remote end (5–92) connected to a manifold, not shown, supplied by a large volume gas tank also not shown. The system illustrated in FIG. 5 is particularly useful for multiple dispensing, such as in a restaurant or tavern where wines of various vintages are sold by the glass.

Figure 6:
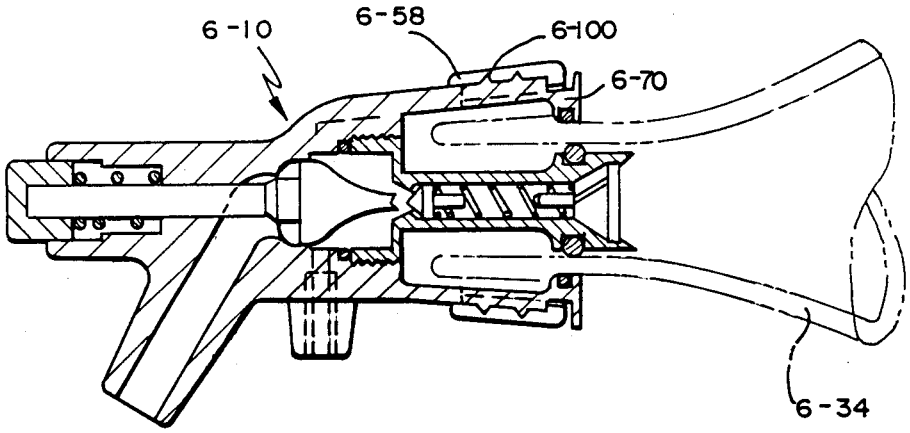
FIG. 6 is a further modification of a horizontal dispenser nozzle with a modified form of locking ring.
Figure 7:
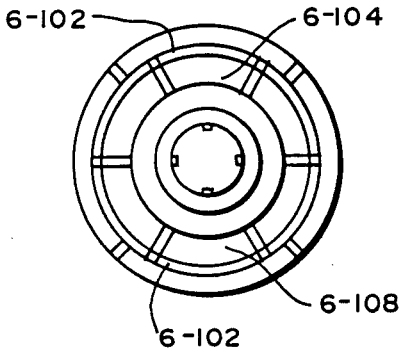
FIG. 7 is a section on line 7—7 of FIG. 6.

Referring now to FIGS. 6 and 7, the dispensing nozzle (6–10) has a modified form of locking ring the locking ring which holds the split cylinder fingers (6–70) in contact with the external surface of the neck of the bottle (6–34) is provided with buttress threads (6–100) which mate with complementary buttress threads (6–102) on two of the legs, specifically designated (6–104) of the split cylinder. When the buttress threads (6–100) of the locking cylinder (6–58) are in engagement with the complementary threads (6–102) on legs or fingers (6–10) and (6–108) the ring prevents accidental removal of the dispenser nozzle (6–10) when the container is pressurized. By rotating the cylinder (6–58 out of engagement with the cooperating threads (6–102) the locking sleeve can be urged upwardly releasing the inward pressure on the legs or fingers (6–70).

While a form of locking ring illustrated in FIGS. 6 and 7 is comparatively less expensive to manufacture it lacks the safety feature provided by the form of the invention, for example illustrated in FIG. 1, wherein the plunger (50) connected to the piston (36) cannot be moved upwardly until pressure within the bottle container has been released.

While various forms of the present invention have been illustrated it should be recognized by those skilled in the art that other modifications may be made without parting from the scope of the appending claims.

We claim:

1. Bottle contents dispensing apparatus comprising a body portion having an outlet chamber, an outlet nozzle in selective communication with the outlet chamber, a manual valve between the outlet chamber and the outlet nozzle, said body portion including a fitment to be inserted in the neck of a bottle, a split skirt surrounding the fitment in spaced relationship, a cylindrical locking ring about the split skirt, said locking ring longitudinally slidable from a position wherein the split skirt is held tightly against an outer surface of the bottle neck to a position wherein the split skirt is free of contact with the outer surface of the bottle neck and means for pressurizing the outlet chamber and a bottle connected to the dispensing apparatus, and wherein the locking ring is held in the position where the split skirt is held tightly against the outer surface of the bottle neck by a piston and piston rod, which engage the locking ring.

2. The invention defined in claim 1 wherein the outlet chamber and the bottle connected to the nozzle are pressurized with nitrogen.

3. The invention defined in claim 1, wherein the means for pressurizing the outlet chamber and the bottle is a pressurized cylinder.

4. The invention defined in claim 1 wherein the nozzle and a bottle connected thereto are pressurized by a disposable gas cartridge.

5. The invention defined in claim 1 wherein the nozzle and a bottle connected thereto are connected by a flexible pressure hose to a manifold.

* * * * *